United States Patent [19]

Schinbeckler

[11] Patent Number: 4,495,933

[45] Date of Patent: Jan. 29, 1985

[54] FIREPLACE INSERT AND METHOD

[76] Inventor: Steven E. Schinbeckler, 212 Gaslight La., Greenfield, Ind. 46140

[21] Appl. No.: 401,846

[22] Filed: Jul. 26, 1982

[51] Int. Cl.[3] ..... F24B 7/00

[52] U.S. Cl. ..... 126/123; 126/120; 126/314; 312/257 SM

[58] Field of Search ..... 126/121–126, 126/138, 140, 285 R, 285 A, 288, 314–319; 312/257 SM; 308/3 R; 285/31, 42

[56] References Cited

U.S. PATENT DOCUMENTS

| | | | |
|---|---|---|---|
| 1,683,548 | 9/1928 | Hughey | 126/315 |
| 2,165,661 | 7/1939 | Stenquist | 126/121 |
| 2,706,395 | 4/1955 | McCrea | 52/219 |
| 3,269,384 | 8/1966 | Adelt | 126/288 |
| 4,329,973 | 5/1982 | Scullin, Jr. | 126/123 |

*Primary Examiner*—Margaret A. Focarino

*Attorney, Agent, or Firm*—Woodard, Weikart, Emhardt & Naughton

[57] ABSTRACT

A fireplace insert and method are disclosed which include L-shaped brackets mounted to the side and back walls of a fireplace, S-shaped brackets received thereon and also receiving a cover plate substantially enclosing the flue of the fireplace. The cover plate is also secured to the lintel and includes an aperture for reception of the flue of a stove received within the fireplace.

6 Claims, 5 Drawing Figures

FIREPLACE INSERT AND METHOD

BACKGROUND OF THE INVENTION

1. Field of the Invention

The present invention relates to the field of apparatus for converting a fireplace for use with a stove having a flue, and particularly to an insert for mounting in the fireplace to adapt to the stove.

2. Description of the Prior Art

It has been known in the past that woodburning stoves and the like have certain advantages over the standard fireplace. For example, the amount of heat which is delivered to a room may typically be greater for a woodburning stove than for a fireplace, particularly in view of the large amount of heat which is passed up through the flue of the standard fireplace.

As a result, it has been recognized that it may be desirable to adapt a fireplace such that a woodburning stove can be set in the fireplace. The walls of the fireplace can then serve as an insulating wall for the hot stove. Also, the fireplace flue can be used for receiving the flue of the stove. In this regard, it has been found desirable to modify the fireplace flue so that there is not a large air space outside of the stove's flue for heat to pass upwardly and out of the home.

In the prior art, various approaches have been taken in order to adapt a fireplace for reception of a woodburning stove. These approaches have typically been somewhat crude, and therefore have been difficult for the home owner to perform. The present invention provides an apparatus and method which is readily used to adapt a fireplace for reception of a woodburning stove.

SUMMARY OF THE INVENTION

In one aspect of the present invention there is provided an apparatus for converting a fireplace for use with a stove, the apparatus including side and back wall supports mounted to the fireplace walls to form a substantially continuous support, a cover plate for closing the fireplace flue, and attachment means mounted to the side wall supports for slidingly receiving the cover plate. In another aspect, a related method for converting the fireplace is also provided.

It is an object of the present invention to provide an apparatus for converting a fireplace to be used with a stove which has a flue.

It is another object of the present invention to provide an apparatus for converting a fireplace, which apparatus is easily installed in the fireplace.

A further object of the present invention is to provide a conversion apparatus which is inexpensive and which utilizes standard, durable materials.

It is another object of the present invention to provide a method for converting a fireplace, which method is readily performed.

Further objects and advantages of the present invention will become apparent from the description of the preferred embodiment that follows.

DESCRIPTION OF THE PREFERRED EMBODIMENT

Figure 1:
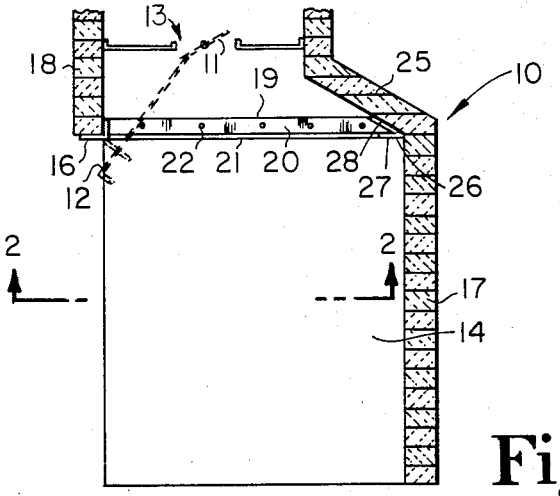
FIG. 1 is a side, cross-sectional view of a fireplace showing the wall supports of the present invention installed.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present apparatus and method provide for the conversion of a fireplace for its use with a stove having a flue. As used herein, it may sometimes be referred to as being for adaption to a woodburning stove, although it will be appreciated that the apparatus has a general purpose of adapting a fireplace for any stove or the like which would have a flue that can be connected with the fireplace flue. Also as described herein, the fireplace is described as including opposed side walls, a back wall, and a front opening which is defined at the top by a lintel secured to a front wall of the fireplace. The typical fireplace will of course also have a floor and perhaps a hearth extending forwardly therefrom. The present invention is useful with a variety of fireplace configurations, with the most typical type of fireplace being described herein for purposes of example.

Before installing the apparatus of the present invention, it will typically be required to clean the interior of the fireplace 10 and remove the closure 11 and handle 12 from the damper system 13. If the closure cannot be removed, then it should be affixed in the fully opened position such as by use of a non-corrosive heat resistant wire (not shown). A line is then drawn from the front to the back of each side wall 14 and 15 to be level with the underneath side of the lintel bar 16. A straight line is then drawn across the back wall 17 to connect the lines on the side walls, thus forming a continuous line around the perimeter of the firebox. The lengths of each of the three lines is then measured and noted for use in preparing the support members to be mounted on these respective walls.

Figure 2:
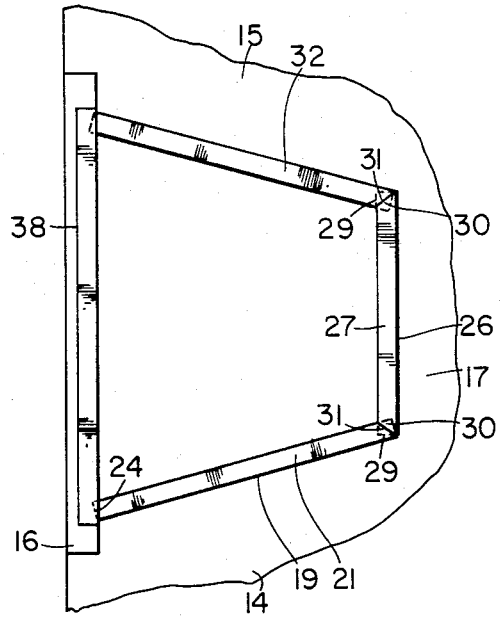
FIG. 2 is a bottom, plan view of the wall supports as shown in FIG. 1, the figure being taken along the line 2—2 in FIG. 1 and looking in the direction of the arrows.
Figure 4:
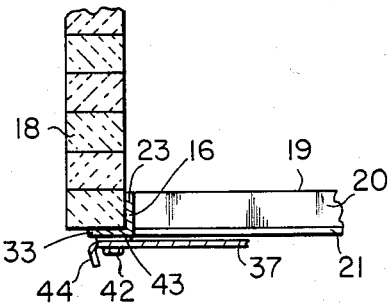
FIG. 4 is a partial, side cross-sectional view showing the front of the cover plate of the present invention secured to the fireplace lintel.

In accordance with the present invention, a length of angle bar is provided for preparing the side and back wall supports. The angle bar is cut to the lengths noted for the two side walls and back wall. In mounting the side wall supports, it will be noted that the angle of the side wall with respect to the front wall 18 will result in an overlap of the horizontal portion of the angle bar over the lintel. For example, side wall support 19 includes a side portion 20 and a bottom portion 21. The side portion extends adjacent the side wall 14 and is mounted with bolts 22. The bottom portion 21 extends horizontally from the side portion 20. As a result, the front edge of the side portion 20 will align properly with the vertical portion 23 of the lintel 16, as shown in particular in FIG. 4. However, as shown in FIG. 2 the horizontal portion 21 will overlap with the lintel 16 to the extent of the portion 24. The amount of the overlap 24 can be marked prior to mounting of the side wall support 19, and thus removed to provide a flush lower surface as shown in FIG. 4.

Similarly, the back wall 17 may include a sloped portion 25 at the same height as the lintel. Thus, the side, vertical portion 20 of the side wall support 19 will have a triangular shaped portion which must be removed in order to have the side portion 20 abut the slope 25 of the back wall.

The back wall support 26 similarly includes a bottom, horizontal portion 27 and a wall portion 28. As shown paticularly in FIG. 2, the horizontal portion 27 will initially overlap with the horizontal portions, such as 21, of the side wall supports. These overlapping segments 29 and 30 are marked, and removed so that an abutting joint 31 is achieved.

It is desirable to seal the joints between the back and side wall supports and the lintel, such as by the application of duct tape at these joints to seal the cracks. It will be appreciated that these same comments apply for the other side wall support 32. As a result, a planar support surface is achieved by means of the lower portion 33 of the lintel 16 and the horizontal portions of the side and back wall supports.

As shown, the fireplace 10 includes a sloped wall 25 in the area at which the supports are mounted horizontal with the lintel. It will be appreciated that in certain fireplace configurations the vertical back wall 17 may extend upwardly to this location. In that event, the side wall supports will not need to be trimmed to conform with the slope, although the overlaps for the horizontal portions will remain. Other variations in the design of the fireplace, such as the inclusion of various angled side walls, can be readily accommodated by similar adaptations of the side and back wall supports. It will also be appreciated that the slope of the wall 25 may vary, and can be accommodated by bending the back wall support 26 to the suitable angle to have the bottom portion 27 extend horizontally. Also, as described, the back and side wall supports are mounted to the respective walls by bolts. For the typical fireplace, a hole may be sited and drilled with a masonry bit and a suitable fastener, such as those referred to as pin grip rivets, may be used for attaching purposes.

Figure 3:
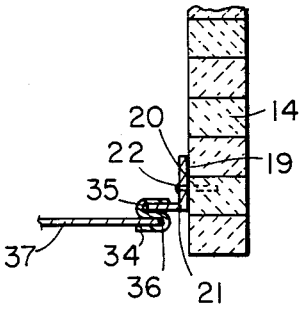
FIG. 3 is an end, cross-sectional view of a side support and S-bracket utilized by the present invention.

There is also provided a length of an S-shaped bracket, meaning that the bracket is an elongated material having an S-shaped cross section. The S-shaped brackets are cut to a length corresponding with the length of each of the side and back wall supports. The brackets 34 are then snapped onto the wall supports, such as shown in FIG. 3 with respect to side wall support 19. As shown, the S-shaped brackets define upper and lower recesses facing in opposite directions. The upper recess 35 receives the respective horizontal member of the L-shaped bracket such as the horizontal portion 21 of the side wall support 19. The lower recesses 36 will then serve as a slide track to slidingly receive the cover plate 37.

Figure 5:
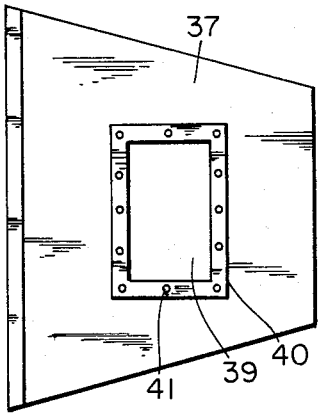
FIG. 5 is a bottom, plan view of the cover plate of the present invention.

A line 38 is then drawn on the bottom of the lintel 16 at a location approximately one and one-half inches from the inside edge of the lintel. The appropriate measurements for the length, width and perimetric edges for the cover plate 37 are then determined and are used to size the cover plate for installation. The cover plate may be conveniently cut from a larger piece of material to enable the insert to be adapted to various sizes and shapes of fireplaces. As shown in FIG. 5, a hole 39 is then cut in the cover plate 37 at the appropriate location and with a configuration corresponding with that for the flue of the stove for which the cover plate is intended. A collar 40 is then secured to the cover plate 37 about the hole 39 by means of sheet metal screws 41.

The cover plate 37 is then slid into the tracks defined by the lower recesses, such as 36, of the S-shaped brackets 34. As shown in FIG. 4, the plate is then secured along the front edge to the lintel 16 by means of screws 42. A length of heat tape 43 is preferably positioned between the cover plate 37 and lintel 16 to provide for an airtight seal along that juncture. It will also be noted that the cover plate 37 preferably includes a lip 44 along the front edge.

At this point, the cover plate is completely installed within the fireplace and the fireplace is adapted for use with a stove having a flue. The stove is then positioned within the fireplace and the flue is connected with the collar 40 on the cover plate 37 in typical fashion. The cover plate is thereby mounted within the fireplace to provide an essentially airtight seal about the entire perimeter of the fireplace flue.

As described herein, the present invention provides an apparatus for converting a fireplace for use with a stove having a flue. Side and back wall supports are mounted to the respective side and back walls of the fireplace by appropriate mounting means. The side and back wall supports are configured and positioned to form a substantially continuous surface along the side and back walls of the fireplace. The S-shaped brackets provide a slide attachment means mounted to the side and back wall supports for slidingly receiving the cover plate and for supporting the cover plate on the side wall supports. In this manner, the cover plate substantially closes the area defined by the front, side and rear walls of the fireplace at the location of the flue.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for converting a fireplace for use with a stove having a flue, the fireplace having opposed side walls, a back wall, and a front opening defined at the top by a lintel secured to a front wall, said apparatus comprising:

a pair of side wall supports;

first mounting means for mounting each side wall support to one of the side walls of the fireplace;

a back wall support;

second mounting means for mounting said back wall support to the back wall of the fireplace, said side and back wall supports being positioned to form a substantially continuous surface along the side and back walls of the fireplace;

a cover plate including an aperture for reception of the stove flue;

slide attachment means mounted to said side and back wall supports for slidingly receiving said cover plate for supporting said cover plate on said side wall supports, said slide attachment means including S-shaped brackets, said cover plate being received by said slide attachment means and being configured to substantially close the area defined by the front, side and rear walls of the fireplace;

said wall supports comprising L-shaped brackets, the S-shaped brackets defining upper and lower recesses facing in opposite directions, the upper recess receiving a respective one of the L-shaped brackets for securement thereto and the lower recess receiving a respective edge of said cover plate; and securement means for securing said cover plate to the lintel of the fireplace.

2. The apparatus of claim 1 and which further includes sealing means for sealing said cover plate with the lintel.

3. The apparatus of claim 2 and which further includes a collar mounted to said cover plate and surrounding the aperture.

4. A method for converting a fireplace for use with a stove having a flue, the fireplace having opposed side walls, a back wall, and a front opening defined at the top by a lintel secured to a front wall, said method comprising the steps of:

a. mounting L-shaped wall supports to each of the side and back walls of the fireplace to form a substantially continuous surface along the side and back walls of the fireplace;

b. mounting sliding brackets to the wall supports, said mounting comprising sliding the upper recesses of S-shaped brackets onto the side wall supports;

c. inserting a cover plate into the sliding brackets for securement of the cover plate to the wall supports, the cover plate including an aperture for the stove flue; and d. securing the front edge of the cover plate to the lintel of the fireplace.

5. The method of claim 4 and which further includes the step of mounting a collar to the cover plate surrounding the aperture.

6. The method of claim 5 and which further includes the step of sealing the front edge of the cover plate to the lintel.

* * * * *